US005636508A

United States Patent [19]

Shaffer et al.

[11] Patent Number: 5,636,508

[45] Date of Patent: Jun. 10, 1997

[54] WEDGE EDGE CERAMIC COMBUSTOR TILE

[75] Inventors: James E. Shaffer, Maitland, Fla.; Allan C. Holsapple, Poway, Calif.

[73] Assignee: Solar Turbines Incorporated, San Diego, Calif.

[21] Appl. No.: 319,850

[22] Filed: Oct. 7, 1994

[51] Int. Cl.[6] ..... F23R 3/44

[52] U.S. Cl. ..... 60/39.32; 60/753

[58] Field of Search ..... 60/752, 753, 39.31, 60/39.32; 431/352, 353; 416/241 B

[56] References Cited

U.S. PATENT DOCUMENTS

| | | | |
|---|---|---|---|
| 2,548,485 | 4/1951 | Lubbock | 60/753 |
| 2,686,655 | 8/1954 | Schorner | 60/753 |
| 3,854,503 | 12/1974 | Nelson et al. | 431/352 |
| 3,918,255 | 11/1975 | Holden | 60/753 |
| 3,956,886 | 5/1976 | Sedgwick | 60/39.32 |
| 5,392,596 | 2/1995 | Holsapple et al. | 431/353 |
| 5,457,954 | 10/1995 | Boyd et al. | 60/39.32 |

*Primary Examiner*—Timothy S. Thorpe
*Attorney, Agent, or Firm*—Larry G. Cain

[57] ABSTRACT

A multipiece combustor has a portion thereof being made of a plurality of ceramic segments. Each of the plurality of ceramic segments have an outer surface and an inner surface. Each of the plurality of ceramic segments have a generally cylindrical configuration and including a plurality of joints. The joints define joint portions, a first portion defining a surface being skewed to the outer surface and the inner surface. The joint portions have a second portion defining a surface being skewed to the outer surface and the inner surface. The joint portions further include a shoulder formed intermediate the first portion and the second portion. The joints provide a sealing interlocking joint between corresponding ones of the plurality of ceramic segments. Thus, the multipiece combustor having the plurality of ceramic segment with the plurality of joints reduces the physical size of the individual components and the degradation of the surface of the ceramic components in a tensile stress zone is generally eliminated reducing the possibility of catastrophic failures.

4 Claims, 7 Drawing Sheets

WEDGE EDGE CERAMIC COMBUSTOR TILE

"The Government of the United States of America has rights in this invention pursuant to Contract No. DE-AC02-92CE40960 awarded by the U.S. Department of Energy"

TECHNICAL FIELD

This invention relates generally to a gas turbine engine and more particularly to a combustor being made from a plurality of tile and to the joint between the plurality of tile.

BACKGROUND ART

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

The gases within the combustor typically range from between 2000 degrees to at least 2500 degrees Fahrenheit. Since the efficiency and work output of the turbine engine are related to the entry temperature of the incoming gases, there is a trend in gas turbine engine technology to increase the gas temperature. A consequence of this is that the materials of which the combustor, blades and vanes are made assume ever-increasing importance with a view to resisting the effects of elevated temperature.

Historically, combustors have been made of metals such as high temperature steels and, more recently, nickel alloys, and it has been found necessary to provide internal cooling passages in order to prevent melting. It has been found that ceramic coatings can enhance the heat resistance of the turbine components. In specialized applications, nozzle guide vanes and blades are being made entirely of ceramic, thus, imparting resistance to even higher gas entry temperatures and requiring higher temperatures within the combustor.

However, if the combustor is made of ceramic, which has a different chemical composition, physical property and coefficient of thermal expansion to that of a metal supporting structure, then undesirable stresses, a portion of which are thermal stresses, will be set up between the combustor and its supports when the engine is operating. It is felt that such undesirable thermal stresses cannot adequately be controlled by cooling.

Furthermore, conventional assembly techniques and methods will require alternative designs, processes and assembly techniques. The structural components of the combustor and the assembly of the combustor within the gas turbine engine will need to be rethought.

Historically, using metallic components, a combustor design has used a multipiece design of segments one overlaps another. The segments are rigidity secured one to another by rivets, bolts and/or welding. Or as an alternative, the combustor has been formed from a single piece. With a ceramic combustor, the integrity of the material and the construction thereof can drastically increase cost and result in premature failure due to flaws in the surface or of the part itself. The larger the physical size of the ceramic shape the lesser the likelihood of producing a component having structural integrity. The sliding friction between the ceramic combustor and the supporting structure can create a contact tensile stress on the ceramic that degrades the surface. If this degradation in the surface of the ceramic occurs in a tensile stress zone of the combustor the surface flaw generated can result in catastrophic failure.

The present invention is directed to overcome one or more of the problems as set forth above.

DISCLOSURE OF THE INVENTION

In one aspect of the invention, a combustor assembly is comprised of an inlet end portion and an outlet end portion. A plurality of segments are interposed the inlet end portion and the outlet end portion. Each of the segments has a first end portion and a second end portion. A means for attaching the plurality of segments is included in the combustor assembly and provides a sliding connection therebetween. The means for attaching also provides a sliding connection between a portion of the segments and the first end portion and the second end portion.

BEST MODE FOR CARRYING OUT THE INVENTION

Figure 1:
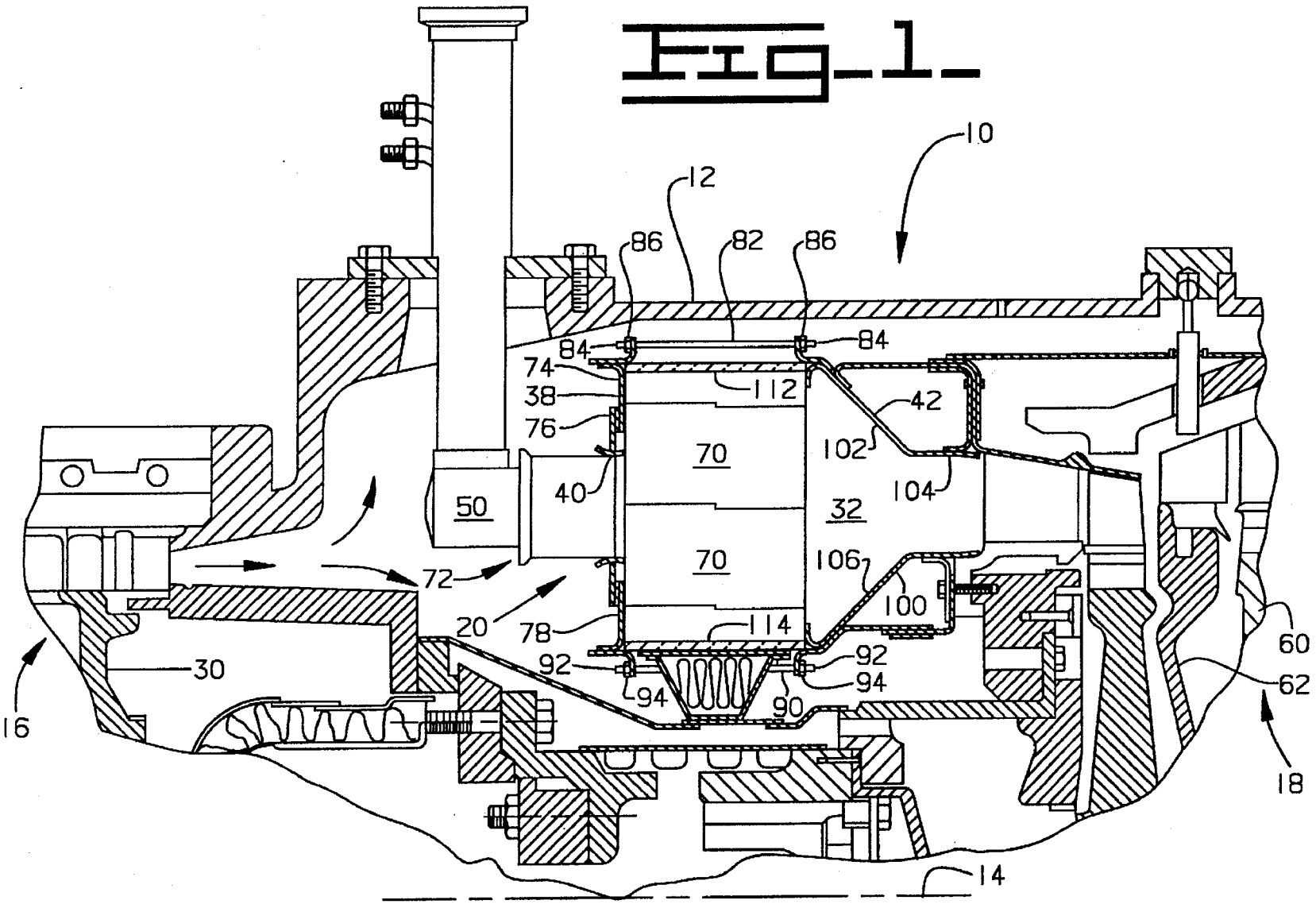
FIG. 1 is a partial side view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30, causes a flow of compressed air which has at least a part thereof communicated to the combustor section 20. The combustor section 20, in this application, includes an annular combustor assembly 32 being supported in the gas turbine engine 10 by a conventional attaching means 34. The combustor assembly 32 has an inlet end portion 38 having a plurality of generally evenly spaced openings 40 therein and an outlet end portion 42. Each of the openings 40 has an injector 50 positioned therein. In this application, the injector nozzle 50 is of the premix type in which air and fuel are premixed prior to entering the combustor assembly 32.

The turbine section 18 includes a power turbine 60 having an output shaft, not shown, connected thereto for driving an accessory component such as a generator. Another portion of the turbine section 18 includes a gas producer turbine 62 connected in driving relationship to the compressor section 16.

In this application, the combustor assembly 32 is constructed of a plurality of ceramic segments 70 defining a plurality of joints therebetween being interposed the inlet end portion 38 and the outlet end portion 42. In this application, the plurality of ceramic segments 70 are made of a reaction bonded or reaction sintered material using silicon as a starting powder. The inlet end portion 38 of the combustor assembly 32 includes a plurality of metallic components 72 assembled in a conventional overlapping configuration. The plurality of metallic components 72 are divided into a plurality of radial outer portions 74, a plurality of center portions 76 and a plurality of radial inner portions 78. The openings 40 are positioned in a portion of the plurality of the center portions 76. Each of the plurality of radial outer portions 78 include a plurality of apertures, not shown, through which a connecting rod 82 is positioned therein. The connecting rod 82 includes a pair of threaded ends 84 and a nut 86 threadedly positioned thereon. Each of the plurality of radial inner portions 78 include a plurality of apertures or openings, not shown, though which a second connecting rod 90 is positioned therein. The second connecting rod 90 includes a pair of threaded ends 92 and a nut 94 threadedly positioned thereon.

The outlet end portion 42 of the combustor assembly 32 includes a plurality of metallic components, shown as a single unit, 100 assembled in a conventional overlapping configuration. The plurality of metallic components 100 are a plurality of generally conical outer portions 102, a plurality of generally cylindrical center portions 104 and a plurality of generally conical inner portions 106. Each of the plurality of generally conical outer portions 102 includes a plurality of apertures, not shown, through which the other threaded end 84 of the connecting rod 82 is positioned therein and the generally conical inner porting 106 includes a plurality of apertures, not shown, through which the other threaded end 92 of the second connecting rod 90 is positioned therein.

As further shown in FIGS. 2, 3, 4, and 5, interposed the inlet end portion 38 and the outlet end portion is a plurality of combustor ring segments 110 which are made up of a plurality of outer combustor ring segments 112 and a plurality of inner combustor ring segments 114. Each of the plurality of outer combustor ring segments 112 have a first end 116 nested in sealing contact with the plurality of radial outer portions 74. A second end 118 of each of the plurality of outer combustor ring segments 112 is nested in sealing contact with the plurality of generally conical outer portions 102. The connecting rods 82 retain sealing contact between the ends 116, 118 of the plurality of outer combustor ring segments 112 and the plurality of radial outer portions 74 and the plurality of generally conical outer portions 102. Each of the plurality of outer combustor ring segments 112 has a generally cylindrical configuration having a preestablished thickness defined between an outer surface 120 and an inner surface 122. In this application, the thickness is equal to about 10 mm. Each of the plurality of outer combustor ring segments 112 has a first joint portion 130 and a second joint portion 132 defined thereon. Each of the joint portions 130, 132 is defined by the first end 116, the second end 118, the outer surface 120 and the inner surface 122. Each of the joint portions 130, 132 has a preestablished length defined between the first end 116 and the second end 118. The joint portions 130, 132 includes a first portion 142 extending from the first end 116 to half way between the first end 116 and the second end 118 and defines a surface 144. A second portion 146 extends from the second end 118 to half way between the first end 116 and the second end 118 and defines a surface 148.

Figure 2:
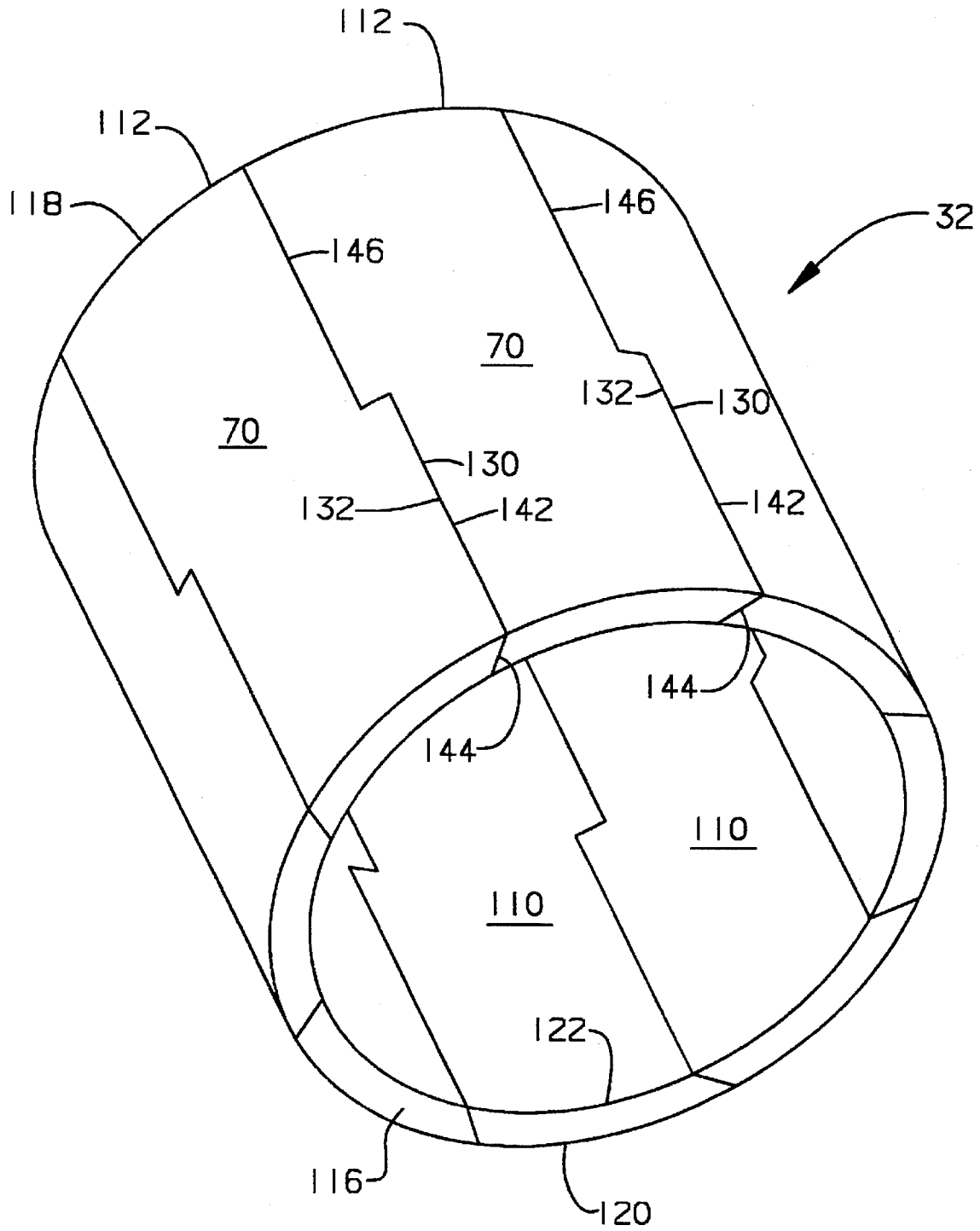
FIG. 2 is an enlarged view of a portion of an outer combustor ring segment of a multipiece segmented ceramic combustor.
Figure 4:
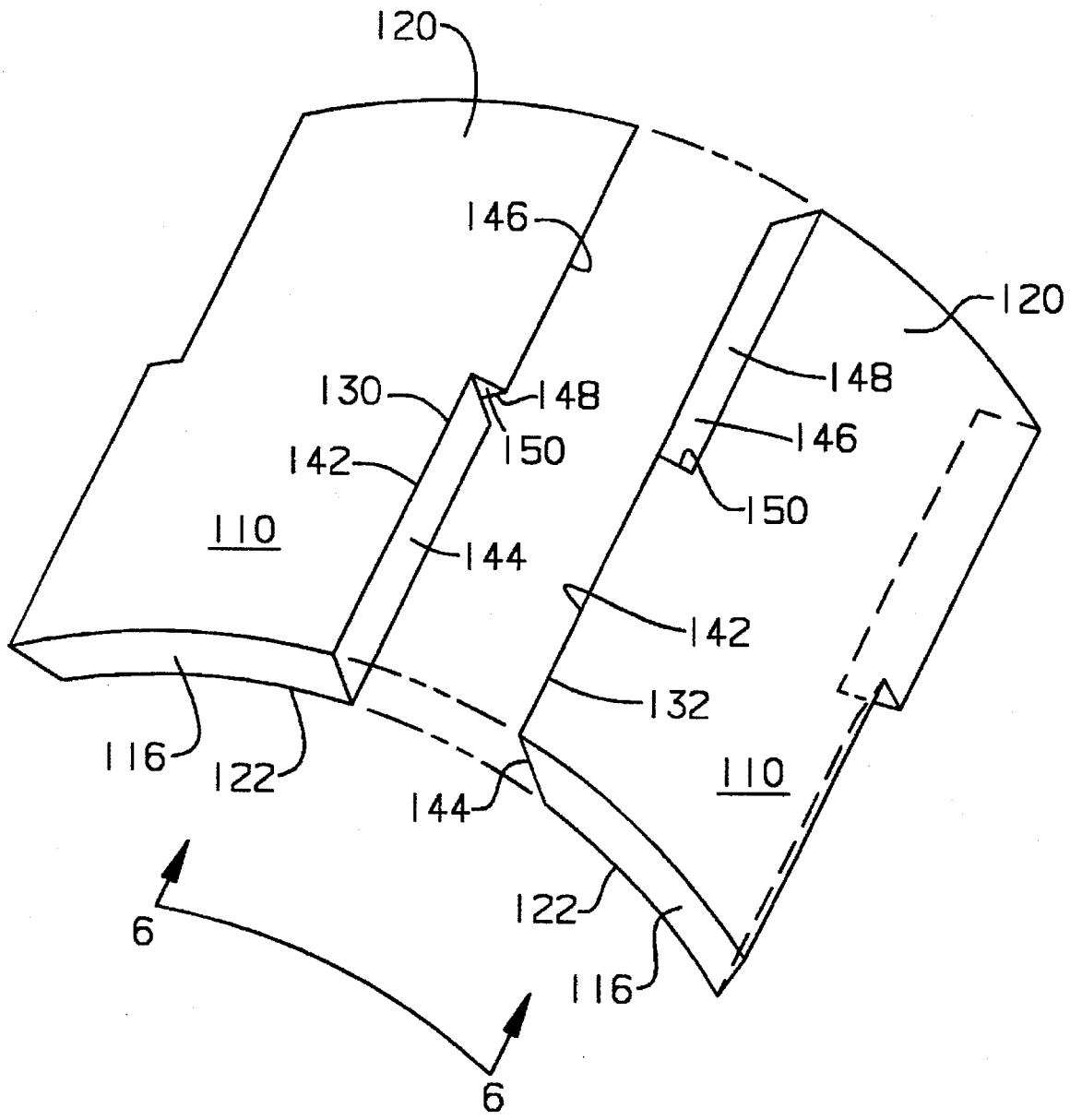
FIG. 4 is an exploded pictorial view of a portion of the multipiece segmented ceramic combustor representing each of a plurality of outer combustor ring segments.
Figure 6:
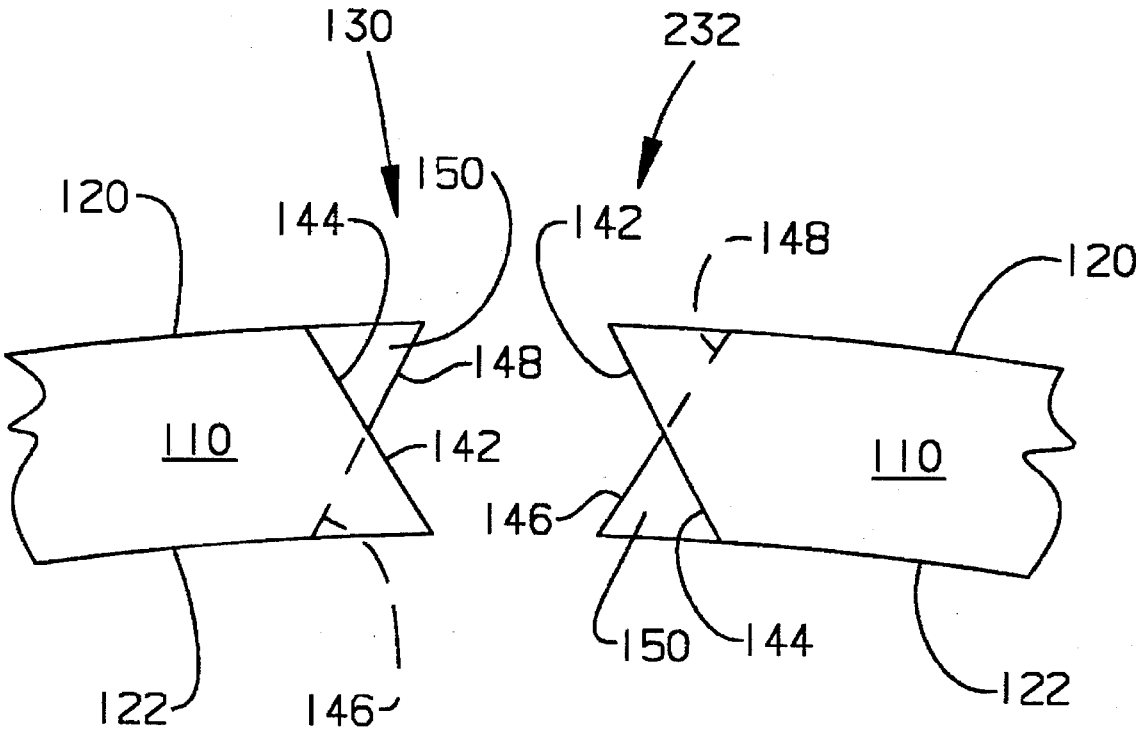
FIG. 6 is an enlarged sectional view of a joint between segments of the plurality of outer combustor ring segments, taken along line 6—6 of FIG. 4.

As best shown in FIGS. 2, 4 and 6, the surface 144 defined on the first portion 142 of the first joint portion 130 is skewed to the outer surface 120 and to the inner surface 122. The angle formed between the outer surface 120 and the surface 144 is about 120 degrees and the angle formed between the inner surface 122 and the surface 144 is about 60 degrees. Furthermore, the surface 148 defined on the second portion 146 is skewed to the outer surface 120 and to the inner surface 122. The angle formed between the outer surface 120 and the surface 148 is about 60 degrees and the angle formed between the inner surface 122 and the surface 148 is about 120 degrees. The surface 144 formed on the first portion 142 is skewed to the surface 148 formed on the second portion 146 and has an included angle of about 120 degrees. The surface 144 defined on the first portion 142 of the second joint portion 132 is skewed to the outer surface 120 and to the inner surface 122. The angle formed between the outer surface 120 and the surface 144 is about 60 degrees and the angle formed between the inner surface 122 and the surface 144 is about 120 degrees. Furthermore, the surface 148 defined on the second portion 146 is skewed to the outer surface 120 and to the inner surface 122. The angle formed between the outer surface 120 and the surface 148 is about 120 degrees and the angle formed between the inner surface 122 and the surface 148 is about 60 degrees. The surface 144 formed on the first portion 142 is skewed to the surface 148 formed on the second portion 146 and has an included angle of about 120 degrees. As an alternative, the angle of the skew can vary, however, the angle of the skew should provide a sealing and interlocking joint between adjacent ones of the plurality of outer combustor ring segments 112. A shoulder 150 is formed between the surface 144 on the first portion 142 and the surface 148 on the second portion 146. In the assembled position, the shoulders 150, the surfaces 144 of the first portions 142 and the surfaces 148 of the second portions 146 are in contacting and sealing relationship.

Figure 3:
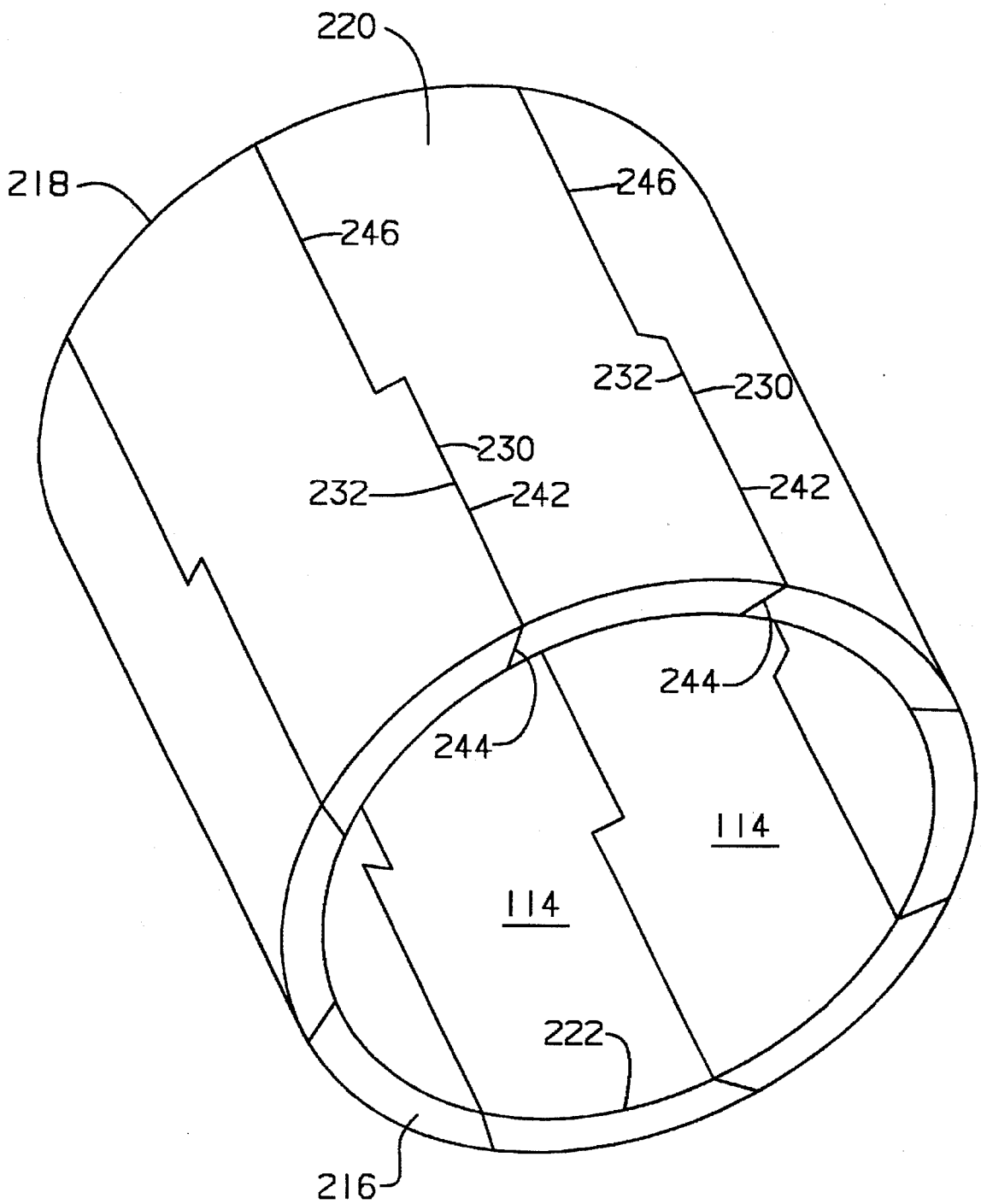
FIG. 3 is an enlarged view of a portion of an inner combustor ring segment of the multipiece segmented ceramic combustor.
Figure 5:
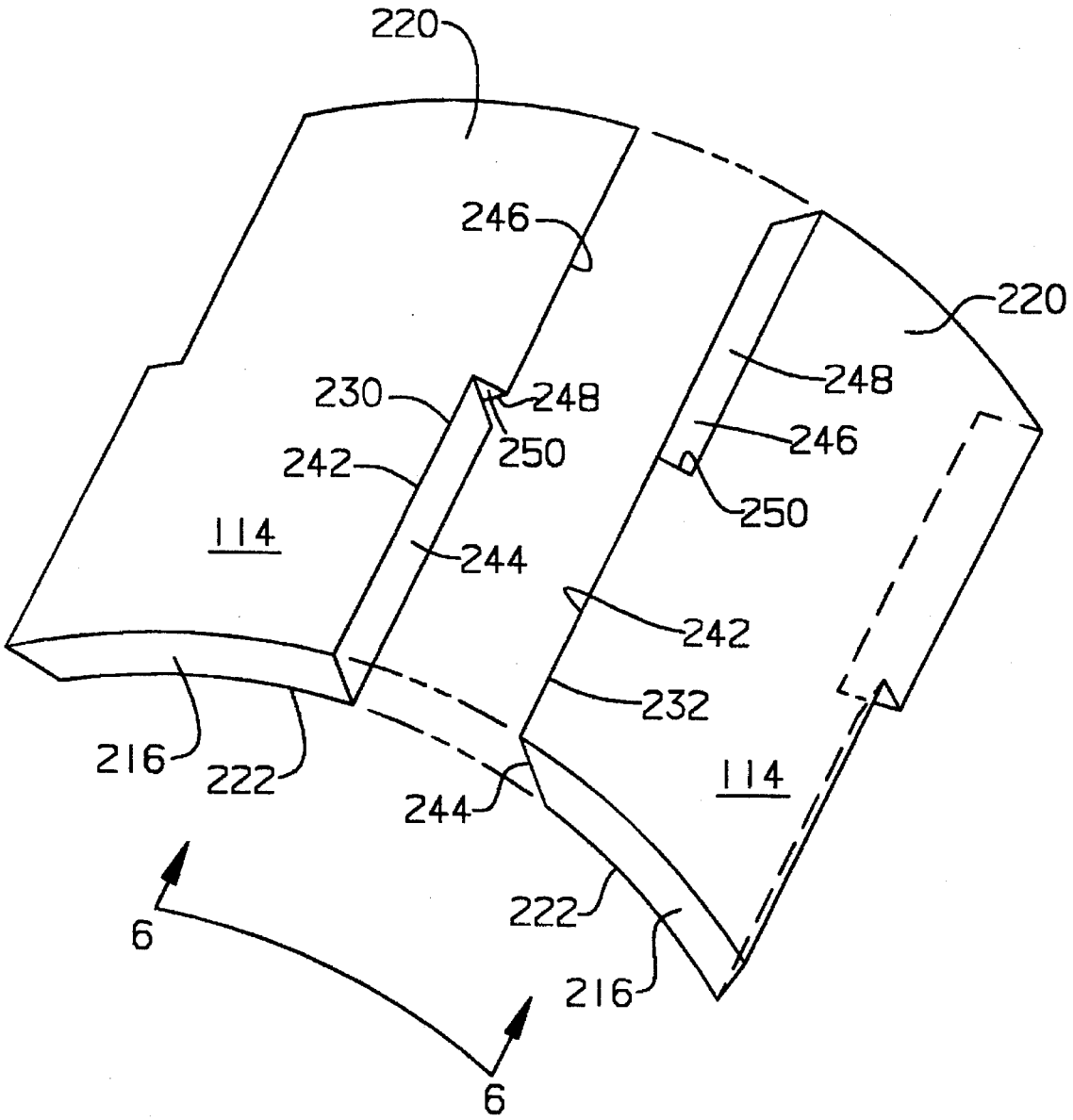
FIG. 5 is an exploded pictorial view of a portion of the multipiece segmented ceramic combustor representing each of a plurality of inner combustor ring segments.
Figure 7:
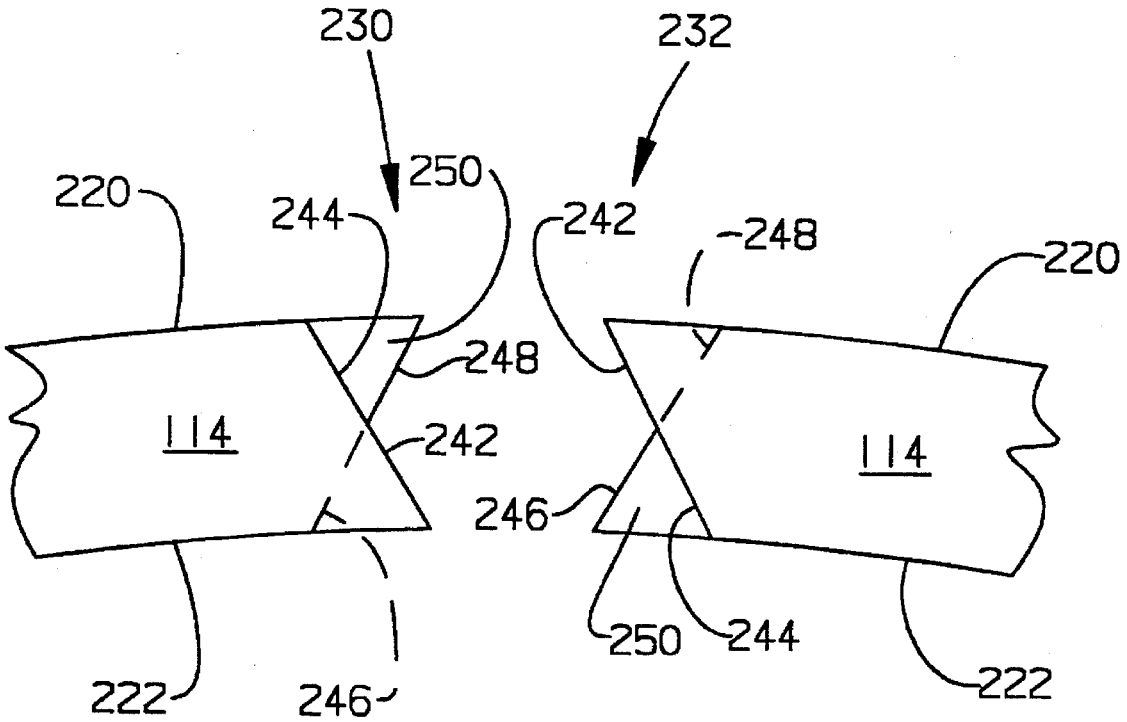
FIG. 7 is an enlarged sectional view of a joint between segments of the plurality of inner combustor ring segments, taken along line 7—7 of FIG. 5.

As best shown in FIGS. 3, 5 and 7, each of the plurality of inner combustor ring segments 114 have a first end 216 nested in sealing contact with the plurality of radial inner portions 78. A second end 218 of each of the plurality of inner combustor ring segments 114 is nested in sealing contact with the plurality of generally conical inner portions 106. The connecting rods 90 retain sealing contact between the ends 216, 218 of the plurality of inner combustor ring segments 114 and the plurality of radial inner portions 78 and the plurality of generally conical inner portions 106. Each of the plurality of inner combustor ring segments 114 has a generally cylindrical configuration having a preestablished thickness defined between an outer surface 220 and an inner surface 222. In this application, the thickness is equal to about 10 mm. Each of the plurality of inner combustor ring segments 114 has a first joint portion 230 and a second joint portion 232 defined thereon. Each of the joint portions 230, 232 is defined by the first end 216, the second end 218, the outer surface 220 and the inner surface 222. Each of the joint portions 230, 232 has a preestablished length defined between the first end 216 and the second end 218. The joint portions 230, 232 includes a first portion 242 extending from the first end 216 to half way between the first end 216 and the second end 218 and defines a surface 244. A second portion 246 extends from the second end 218 to half way between the first end 216 and the second end 218 and defines a surface 248.

As best shown in FIG. 7, the surface 244 defined on the first portion 242 of the first joint portion 230 is skewed to the outer surface 220 and to the inner surface 222. The angle formed between the outer surface 220 and the surface 244 is about 120 degrees and the angle formed between the inner surface 222 and the surface 244 is about 60 degrees. Furthermore, the surface 248 defined on the second portion 246 is skewed to the outer surface 220 and to the inner surface 222. The angle formed between the outer surface 220 and the surface 248 is about 60 degrees and the angle formed between the inner surface 222 and the surface 248 is about 120 degrees. The surface 244 formed on the first portion 242 is skewed to the surface 248 formed on the second portion 246 and has an included angle of about 120 degrees. The surface 244 defined on the first portion 242 of the second joint portion 232 is skewed to the outer surface 220 and to the inner surface 222. The angle formed between the outer surface 220 and the surface 244 is about 60 degrees and the angle formed between the inner surface 222 and the surface 244 is about 120 degrees. Furthermore, the surface 248 defined on the second portion 246 is skewed to the outer surface 220 and to the inner surface 222. The angle formed between the outer surface 220 and the surface 248 is about 120 degrees and the angle formed between the inner surface 222 and the surface 248 is about 60 degrees. The surface 244 formed on the first portion 242 is skewed to the surface 248 formed on the second portion 246 and has an included angle of about 120 degrees. As an alternative, the angle of the skew can vary, however, the angle of the skew should provide a sealing and interlocking joint between adjacent ones of the plurality of inner combustor ring segments 114. A shoulder 250 is formed between the surface 244 on the first portion 242 and the surface 248 on the second portion 246. In the assembled position, the shoulders 250, the surfaces 244 of the first portions 242 and the surfaces 248 of the second portions 246 are in contacting and sealing relationship.

The first and second joint portions 230, 232 are easily manufactured since they include generally flat surfaces 244, surfaces 248 and the shoulders 240. With the plurality of segments 70 being made of a ceramic material, the flat surfaces 244, 248 and the shoulders 250, in this application, are ground in a single pass or uniform passes. Thus, the time consuming manufacturing procedures and setups for making joints requiring a tongue and groove configurations is eliminated and a simple unique interlocking joint is provided. As a further alternative, any number of interlocking surfaces could be without changing the essence of the invention.

INDUSTRIAL APPLICABILITY

In use, the gas turbine engine 10 is started and allowed to warm up and is used in any suitable power application. As the demand for load or power is increased, the engine 10 output is increased by increasing the fuel and subsequent air resulting in the temperature within the engine 10 increasing. The components used to make up the gas turbine engine 10, being of different materials and different rates of thermal expansion, grow at different rates and the forces resulting therefrom and acting thereon must structurally be compensated for to increase life and efficiency of the gas turbine engine. For example, as the fuel and air is injected into the combustor assembly from the injector nozzle 50, the mixture begins to burn. As the burning mixture moves axially along the combustor assembly 32 from the inlet end portion 38 to the outlet end portion 42, the temperature increases to a maximum of about 2500 degrees Fahrenheit. For example, near the inlet end portion 38 the temperature will be the coolest and near the outlet end portion 42 the temperature will be the hottest. The temperature of the plurality of ring members 70 each receive a different temperature gradient from the inlet end portion 38 to the outlet end portion 42 and expand differently. The radial expansion of the individual ring members 70 and its mating counterpart is generally increasing from the inlet end portion 38 toward the outlet end portion 42. Furthermore, the radial expansion of individual ring members 70 differ in the axial direction due to the difference in thermal temperature axially along the combustor assembly 32 from the inlet end portion 38 to the outlet end portion 42. Thus, the actual expansion, in both the radial and axial dimension, of each of the plurality of ring members 70 differs one from another. Furthermore, the temperature gradient along the axial length of individual ring members 70 differs and expands dimensionally differently in the radial direction and the axial direction along the axial length of the individual ring members 70.

To compensate for the difference in dimensional expansion, the combustor assembly 32 is made up of the plurality of combustor ring segments 110. The plurality of outer combustor ring segments 112 are interposed the inlet end portion 38 and the outlet end portion 42. Each of the plurality of outer combustor ring segments 112 has the first end 116 in sealing contacting relationship with the inlet end portion 38. And, the second end 118 is in sealing contacting relationship with the outlet end portion 42. The connecting rods 82 interconnect the outer extremity of the inlet end portion 38, the plurality of outer combustor ring segments 112 and the outlet end portion 42. Each of the plurality of outer combustor ring segments 112 are interconnected by the overlapping first joint portion 130 and the second joint portion 132. The overlapping interconnecting design locates and seals the joint portions 130, 132 therebetween.

As stated above to compensate for the difference in dimensional expansion, the combustor assembly 32 is made up of the plurality of combustor ring segments 110. The plurality of inner combustor ring segments 114 are interposed the inlet end portion 38 and the outlet end portion 42. Each of the plurality of inner combustor ring segments 114 has the first end 216 in sealing contacting relationship with the inlet end portion 38. And, the second end 218 is in sealing contacting relationship with the outlet end portion 42. The connecting rods 90 interconnect the outer extremity of the inlet end portion 38, the plurality of inner combustor ring segments 114 and the outlet end portion 42. Each of the plurality of inner combustor ring segments 114 are interconnected by the overlapping first joint portion 230 and the second joint portion 232. The overlapping interconnecting design locates and seals the joint portions 230, 232 therebetween.

In view of the foregoing, it is readily apparent that the structure of the present invention provides an improved combustor assembly 32. The plurality of combustor ring segments 110 which make up the combustor assembly 32 are made of a ceramic material and have a slidably overlapping joint portion 130, 132; 230, 232 therebetween which is simple to manufacture. The plurality of combustor ring segments 110 and the joint portions 130, 132; 230, 232 therebetween allow the individual segments to expand and contract as the heat axially along the combustor assembly 32 varies. The structural arrangement of the jointed 130, 132; 230, 232 segments and the material provide a combustor assembly 32 in which higher temperatures can be attained while maintaining structural reliability. The increased liner wall temperature may reduce emissions, increase combustor efficiency and extend the lean blowout limit.

Other aspects, objects and advantages of this invention can be obtained from a study of the drawings, the disclosure and the appended claims.

We claim:

1. A combustor assembly comprising:

an inlet end portion and an outlet end portion;

a plurality of segments interposed the inlet end portion and the outlet end portion, each of said segments having joints therebetween and said segments define a first end being in sealing relationship to the inlet end portion and a second end being in sealing relationship to the outlet end portion, each of said plurality of segments includes a joint portion having a first portion extending from the first end and a second portion extending from the second end and having a shoulder formed therebetween the first portion and the second portion, and wherein each of said plurality of segments has an outer surface and an inner surface; and said first portion including a surface and said second portion including a surface, said shoulder being interposed the surface of the first portion and the surface of the second portion and said surface of the first portion being skewed to the outer surface at an angle of about 120 degrees and said surface of the second portion being skewed to the outer surface at an angle of about 60 degrees.

2. The combustor assembly of claim 1 wherein said plurality of segments have a preestablished length and said shoulder is equally spaced between said first end and the second end.

3. The combustor assembly of claim 1 wherein said surface of the first portion is skewed to the inner surface at an angle of about 60 degrees.

4. The combustor assembly of claim 1 wherein said surface of the second portion is skewed to the inner surface at an angle of about 120 degrees.

* * * * *